US006664459B2

(12) United States Patent
Lee et al.

(10) Patent No.: US 6,664,459 B2
(45) Date of Patent: Dec. 16, 2003

(54) MUSIC FILE RECORDING/REPRODUCING MODULE

(75) Inventors: Sung-lyong Lee, Seoul (KR); Tae-hong Jeong, Seongram-si (KR)

(73) Assignee: SamSung Electronics Co., Ltd., Suwon (KR)

( * ) Notice: Subject to any disclaimer, the term of this patent is extended or adjusted under 35 U.S.C. 154(b) by 134 days.

(21) Appl. No.: 09/954,020

(22) Filed: Sep. 18, 2001

(65) Prior Publication Data

US 2002/0033089 A1 Mar. 21, 2002

(30) Foreign Application Priority Data

Sep. 19, 2000 (KR) ..... 2000-54996
May 11, 2001 (KR) ..... 2001-25871

(51) Int. Cl.[7] ..... A63H 5/00; G04B 13/00; G10H 7/00

(52) U.S. Cl. ..... 84/609; 323/371; 704/270

(58) Field of Search ..... 84/609, 634; 323/371; 704/113, 115, 118, 103, 202, 205, 206, 270

(56) References Cited

U.S. PATENT DOCUMENTS 5,691,964 A * 11/1997 Niederlein et al. ..... 369/30.06
5,839,108 A * 11/1998 Daberko et al. ..... 704/270
5,993,220 A * 11/1999 Nakamura et al. ..... 434/307 A
6,385,394 B1 * 5/2002 Okada et al. ..... 386/125
2002/0072817 A1 * 6/2002 Champion ..... 700/94
2002/0175665 A1 * 11/2002 O'Grady et al. ..... 323/371
2002/0184457 A1 * 12/2002 Yuasa et al. ..... 711/161

* cited by examiner

*Primary Examiner*—Jeffrey Donels
(74) *Attorney, Agent, or Firm*—Robert E. Bushnell, Esq.

(57) ABSTRACT

A music file recording/reproducing module is mounted in a module rack of an audio/video (AV) system capable of reproducing input audio data, and receives audio data encoded by a predetermined encoding method, decodes the received audio data, and sends the decoded audio data to the AV system. By doing so, a music file is received from an outside source, is stored, and is decoded so that the received music file can be reproduced. That is, the music file recording/reproducing module causes the AV system to receive various music files, such as an MP3 file transmitted through the Internet, and to store and reproduce the music files. The module comprises a communications interface unit for receiving encoded audio data, a decoder for decoding the encoded audio data, and a control unit for sending the decoded audio data to the AV system. An audio reading unit, an audio writing unit, and an audio storage unit are also provided.

20 Claims, 10 Drawing Sheets

MUSIC FILE RECORDING/REPRODUCING MODULE

CLAIM OF PRIORITY

This application makes reference to, incorporates the same herein, and claims all benefits accruing under 35 U.S.C. §119 from my two applications MODULE AND METHOD FOR RECORDING AND REPRODUCING MUSIC FILE IN MODULAR TELEVISION APPARATUS filed with the Korean Industrial Property Office on Sep. 19, 2000 and there duly assigned Ser. No. 54996/2000, and MUSIC FILE RECORDING/REPRODUCING MODULE FOR AV SYSTEM filed with the Korean Industrial Property Office on May 11, 2001 and there duly assigned Ser. No. 25871/2001.

BACKGROUND OF THE INVENTION

1. Technical Field

The present invention relates to an audio/video (AV) system and, more particularly, to a music audio file recording/reproducing module mounted in an AV system that reproduces various AV source data.

2. Related Art

Digital ground wave broadcasting which complies with the Advanced Television Systems Committee (ATSC) standards began in November 1998. Consumer electronics product manufacturers are disclosing various digital media products, including digital televisions capable of receiving digital broadcasts, and digital versatile disc (DVD) players and digital camcorders capable of recording and reproducing digital broadcasts.

As various digital media apparatuses particularly related to the digital TV market are disclosed, potential consumers are being confused. New specifications are being developed at such a fast rate that digital TVs are becoming more complicated and new products are quickly becoming obsolete.

New digital media products, such as digital broadcast receiving apparatuses, satellite broadcast receiving apparatuses, DVD players, hard disc drives, and Internet access apparatuses, are being designed in such a way as to increase the number of manipulation methods a user has to learn and the number of remote controllers which must be used. In addition, a user has to pay a lot of money to buy such digital media products. Also, the digital media products take up a large amount of space in a house, and each digital media product needs a power line for operation. It is very burdensome to connect lines between a DVD player and a digital TV monitor.

Meanwhile, the appearance of digital media products has made it possible to have a home network connecting multiple home appliances in a house. If the home network is implemented, a user can control multiple appliances in the house with only one controller. In addition, the user can control the appliances in the house through the Internet, even when the user is in a remote place.

Also, the developments in digital technology have enabled music, which was once provided in analog format, to be provided in digital format. In particular, in line with developments in compression technologies and error correction technologies, a music audio file, which is usually bigger than a text file, can be freely transmitted and received through the Internet.

SUMMARY OF THE INVENTION

It is an object of the present invention to provide a music file recording/reproducing module mounted in an AV system, which implements a plurality of digital media apparatuses in one system, the music file recording/reproducing module storing a music file received from the outside and reproducing the received music file.

To accomplish the object of the present invention, there is provided a music file recording/reproducing module, which is mounted in a module rack formed in an audio/video (AV) system capable of reproducing audio data, the music file recording/reproducing module comprising: a communications interface unit for receiving audio data, which is encoded by a predetermined encoding method, from the AV system; a decoder for decoding the audio data, which is encoded by the encoding method; and a control unit for sending the audio data, which is decoded by the decoder, to the AV system.

It is preferable that the music file recording/reproducing module further comprise: an audio storage unit in which audio data is recorded; and an audio writing unit for writing the encoded audio data in the audio storage unit; wherein the control unit receives a record command input from a user, and sends the command to the audio recording unit.

It is preferable that the music file recording/reproducing module further comprise an audio reading unit for reading the encoded audio data written in the audio storage unit, wherein the decoder decodes the encoded audio data read by the audio reading unit and the control unit receives a read command input from the user, sends the command to the audio reading unit, and sends the audio data, which is decoded by the decoder, to the AV system.

It is preferable that the audio storage unit comprise an external memory card in which audio data encoded by the encoding method is stored, and an external memory card mounting unit in which the external memory card is detachably mounted.

It is preferable that the encoding method be an MP3 method, and that the decoder be an MP3 decoder. It is preferable that the AV system have an IEEE1394 interface module, and that the communications interface unit be an IEEE1394 interface module which communicates with the IEEE1394 interface module contained in the AV system.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DESCRIPTION OF THE PREFERRED EMBODIMENTS

Figure 1A:
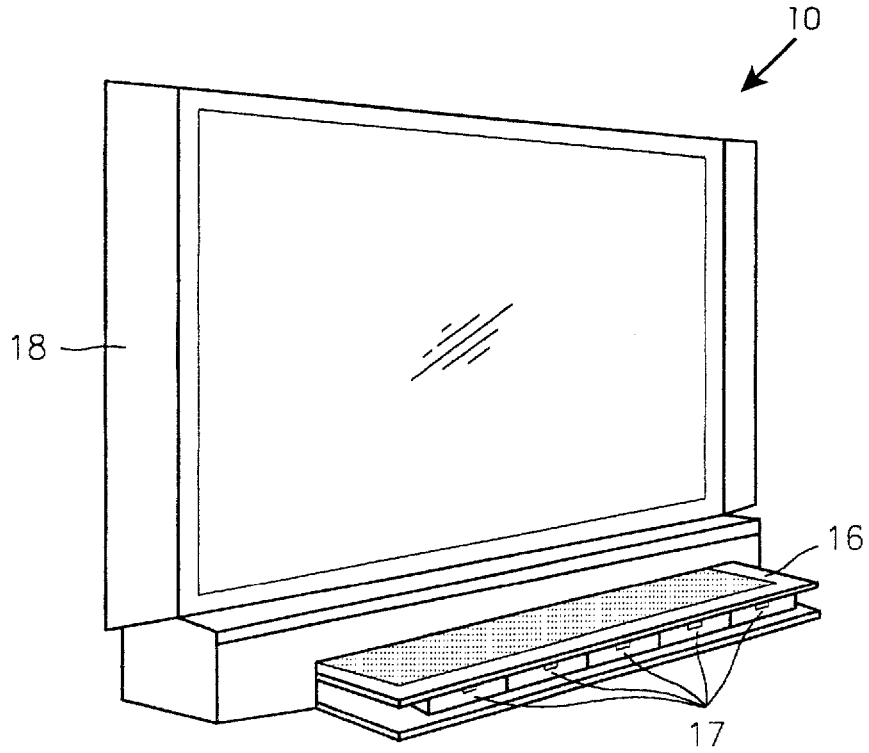
FIGS. 1A, 1B and 1C are views illustrating the external appearance of a modular television as a preferred embodiment of an audio/video (AV) system.
Figure 1B:
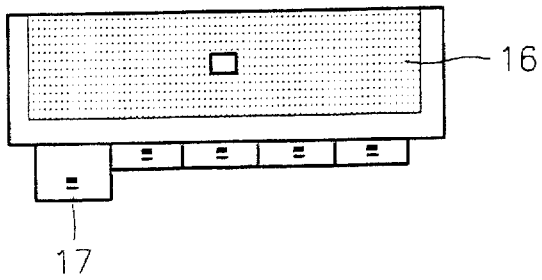
Figure 1C:
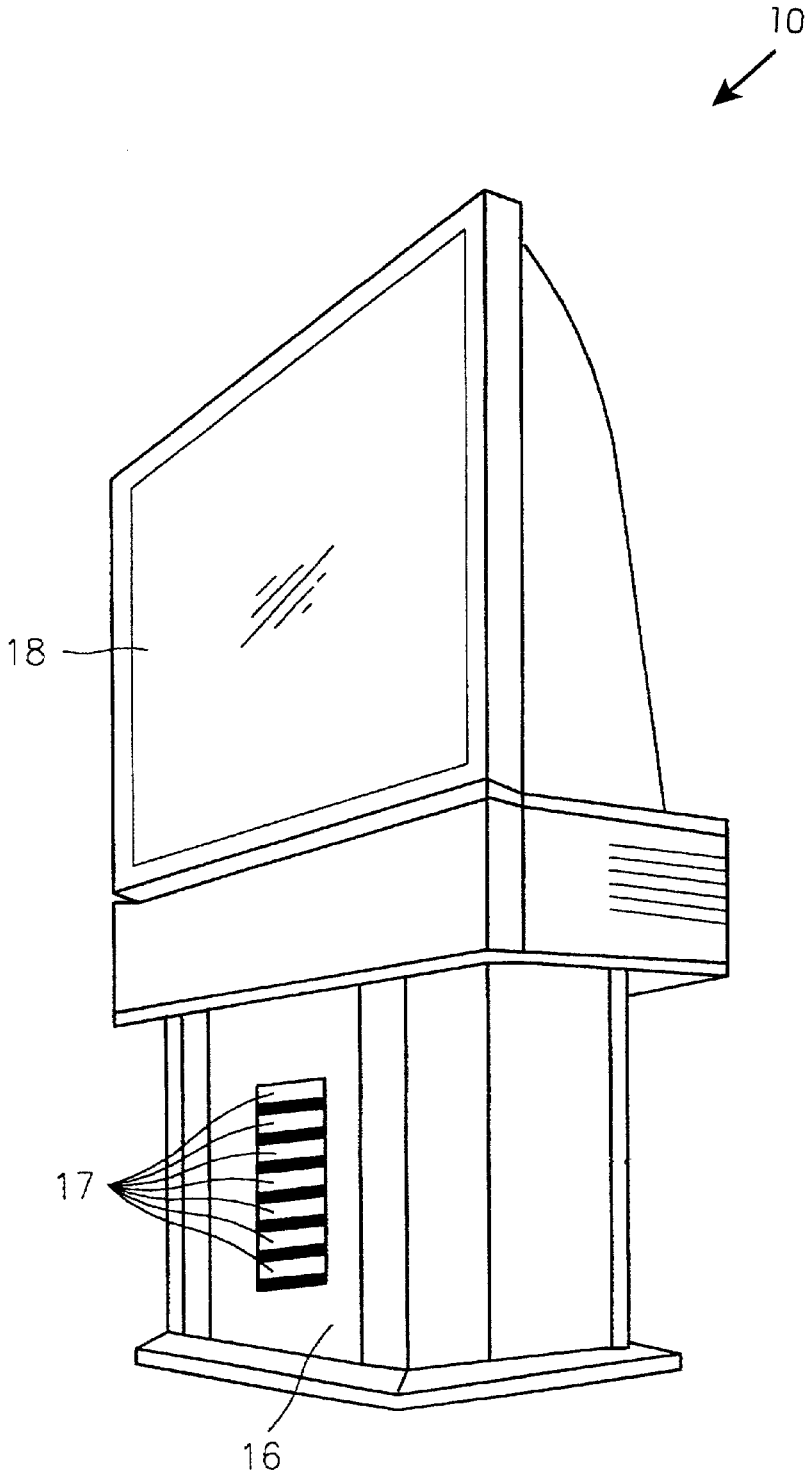

FIGS. 1A and 1C are views illustrating the external appearance of a modular TV system, while FIG. 1B is a plan view of the function-extending modules of FIG. 1. Referring to FIG. 1A, the modular TV system has a display device 18 supported by a TV stand 10. The display device 18 may be a cathode-ray tube (CRT), a ferroelectric LCD (FLCD), a field emission display (FED), or a plasma display panel (PDP). A module rack 16 is installed at the center of the TV stand 10 under the display device 18, and speakers (not shown) are installed to the right and left of the module rack 16.

A plurality of module-inserting holes are formed in the front of the module rack 16 so that function-extending modules 17 can be detachably inserted into the holes. Referring to FIGS. 1A and 1B, module-inserting holes may be formed in a horizontal line so that a plurality of function-extending modules 17 can be inserted in a row. Referring to FIG. 1C, module-inserting holes may be formed in a vertical line so that modules 17 are arranged vertically in the module rack 16.

The function-extending modules 17 are for extending the functions of the modular TV system. For example, if a user buys a DVD module and installs the DVD module in the module rack 16, the modular TV system will have a DVD player function.

A base module (not shown) is installed at the back of the module rack 16. The base module communicates control commands with the function-extending modules 17 in a client-server fashion. That is, the base module receives necessary control information from the function-extending modules 17 inserted into the module rack 16, and outputs and displays the received control information on the display device 18. If a user input corresponding to the displayed control information is received, the base module sends the user input to the corresponding function-extending modules 17. The function-extending modules 17 send AV data corresponding to the received user input to the base module. The base module processes the received AV data, and then outputs the AV data to the display device 18 and/or the speakers (not shown).

The function-extending modules 17 store control information for controlling themselves. If the function-extending modules 17 are inserted into the module rack 16, the control information is sent to the base module. Based on the received control information, the base module (not shown) sends control commands to the corresponding function-extending modules 17. For example, each of the function-extending modules 17 may store one or more index pages as control information. Also, a browser for browsing function-extending modules 17 is installed in the base module. The browser displays for the user a main page in which selection information for at least one function-extending module is contained. The browser requests an index page from a function-extending module selected by the user through the main page, and displays the index page to the user. If the user inputs a control command through the displayed index page, the browser sends the control command again to the function-extending module.

Figure 2:
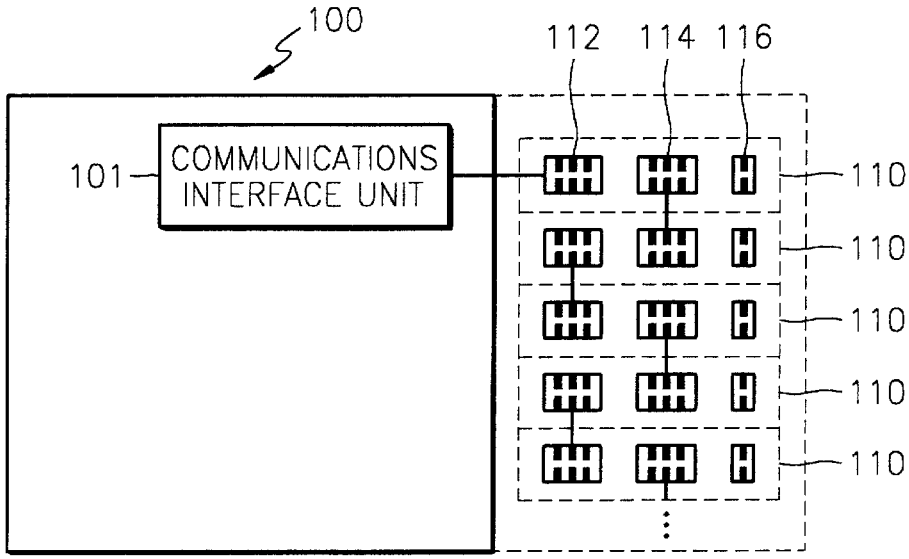
FIGS. 2 and 3 are diagrams illustrating structures for connecting a base module and function-extending modules through a module rack.
Figure 3:
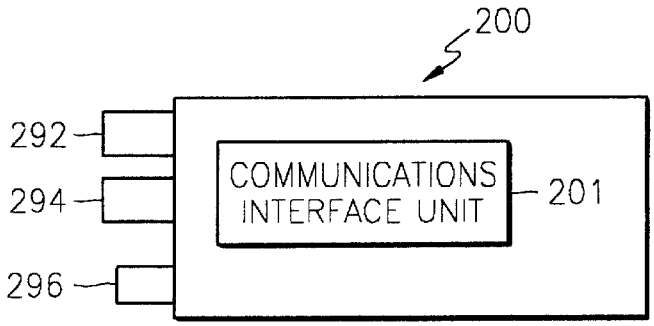

FIGS. 2 and 3 are diagrams for explaining structures for connecting a base module and function-extending modules through a module rack. Referring to FIG. 2, the base module 100 has a plurality of connectors 110 for module connection. Each connector 110 contains two communications ports 112 and 114 and one power connection port 116. The two communications ports 112 and 114 and the power connection port 116 are designed so that each function-extending module can be easily inserted into a module-inserting hole (not shown) of the module rack 16, thereby connecting the ports 112, 114 and 116 to ports (to be explained later) of the function-extending extending modules.

Referring to FIG. 3, a music file recording/reproducing module 200, which is one of the function-extending modules 17 in FIGS. 1A and 1B, has two communications ports 292 and 294 and one power connection port 296. The function-extending module 200 is in the form of a casing, and the communications ports 292 and 294 and power connection port 296 are formed so as to protrude from the casing. Therefore, if the function-extending module 200 is inserted into a module-inserting hole formed in the module rack 16, the corresponding ports 112, 114, 116 and 292, 294, 296 contact each other, and the base module 100 and the function-extending module 200 are electrically connected. Also, if a plurality of function-extending modules 200 are inserted into the module rack 16, the plurality of function-extending modules 200 are connected to the base module 100 in a daisy-chain fashion. The method for connecting the base module 100 to the plurality of function-extending modules 200 may be determined in various ways as needed. In this case, communications ports 112 and 114 of the base module 100 and communications ports 292 and 294 of the function-extending module are electrically connected to their own communications interface units 101 and 201, respectively.

Figure 4:
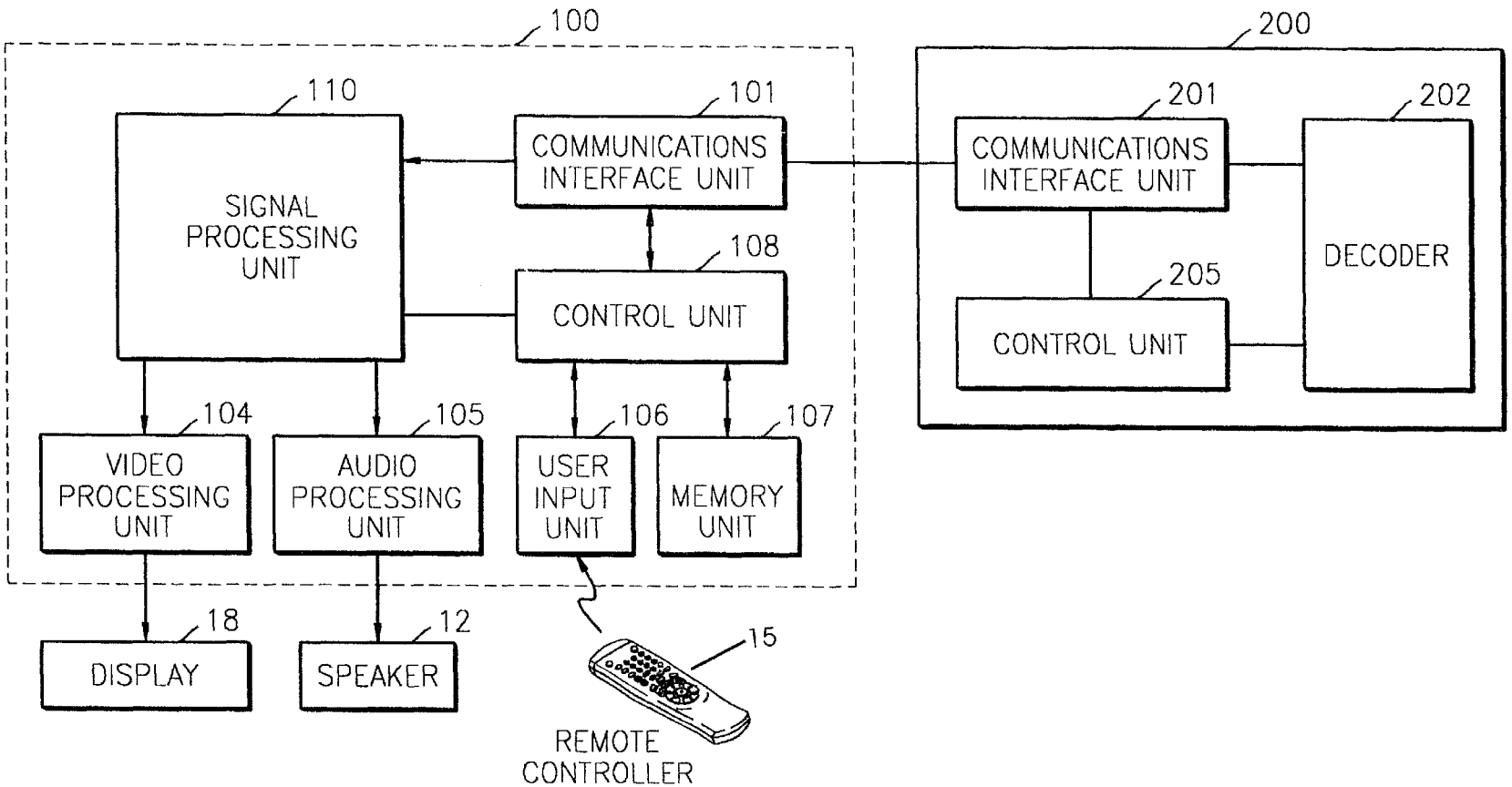
FIG. 4 is a block diagram of a music file recording/reproducing module.

FIG. 4 is a block diagram of a music file recording/reproducing module. Referring to FIG. 4, a base module 100 has a communications interface unit 101, a signal processing unit 110, a video processing unit 104, an audio processing unit 105, a user input unit 106, a memory unit 107, and a control unit 108.

The memory unit 107 includes a random access memory (RAM), a read-only memory (ROM), and a flash memory depending on the embodiment of the present invention. The RAM is used as a buffer for processing image data which forms a main page to be explained later, the ROM stores a browser for browsing a function-extending module 200, and the flash memory stores the Internet protocol (IP) address of the function-extending module 200.

The control unit 108 receives an IP address from the function-extending module 200 mounted in the module rack 16, and operates the browser stored in the memory unit 107 so that the base module 100 communicates with the function-extending module 200 through the communications interface unit 101 in a client-server fashion.

The user input unit 106 receives user inputs, which are input through a command key (not shown) provided in the user input unit 106 or through a remote controller 15, and sends the user inputs to the control unit 108. The communications interface unit 101 carries on data communication with outside sources. In the signal processing unit 110, the AV data, which is received through the communications interface unit 101, is divided into video data and audio data, and is processed. Then, the video data and audio data are output to the video processing unit 104 and the audio processing unit 105, respectively. The video processing unit 104 processes the video data output from the signal processing unit 110, and sends the video data to the display device 18, and the audio processing unit processes the audio data output from the signal processing unit 110, and sends the audio data to the speakers 12. In particular, as will be explained, if the music file recording/reproducing module 200 is set to a recording mode and a digital broadcast signal is input as an MPEG transport stream, the signal processing unit 110 extracts MP3 audio data from the MPEG transport stream, and sends the extracted MP3 audio data to the music file recording/reproducing module 200. Also, if the music file recording/reproducing module 200, which is a function-extending module according to the present invention, is set to a reproducing mode and decoded audio data is sent by the music file recording/reproducing module 200, the signal processing unit 110 processes the received audio data and sends the data to the audio processing unit 105.

The music file recording/reproducing module 200 has a communications interface unit 201, a decoder 202, and a control unit 205. The decoder 202 decodes audio data, which is encoded by a predetermined encoding method. The control unit 205 sends the audio data decoded by the decoder 202 to the base module 100 through the communications interface unit 201.

The communications interface units 101 and 201 are implemented as communications interface modules complying with an IEEE1394 protocol.

Also, the communications interface units 101 and 201 may be connected using a universal serial bus (USB), a peripheral component interconnect (PCI) bus, or a fast-Ethernet. Other communications protocols that support an appropriate transmission speed with respect to audio data sent from the music file recording/reproducing module 200 may be adopted.

Figure 5:
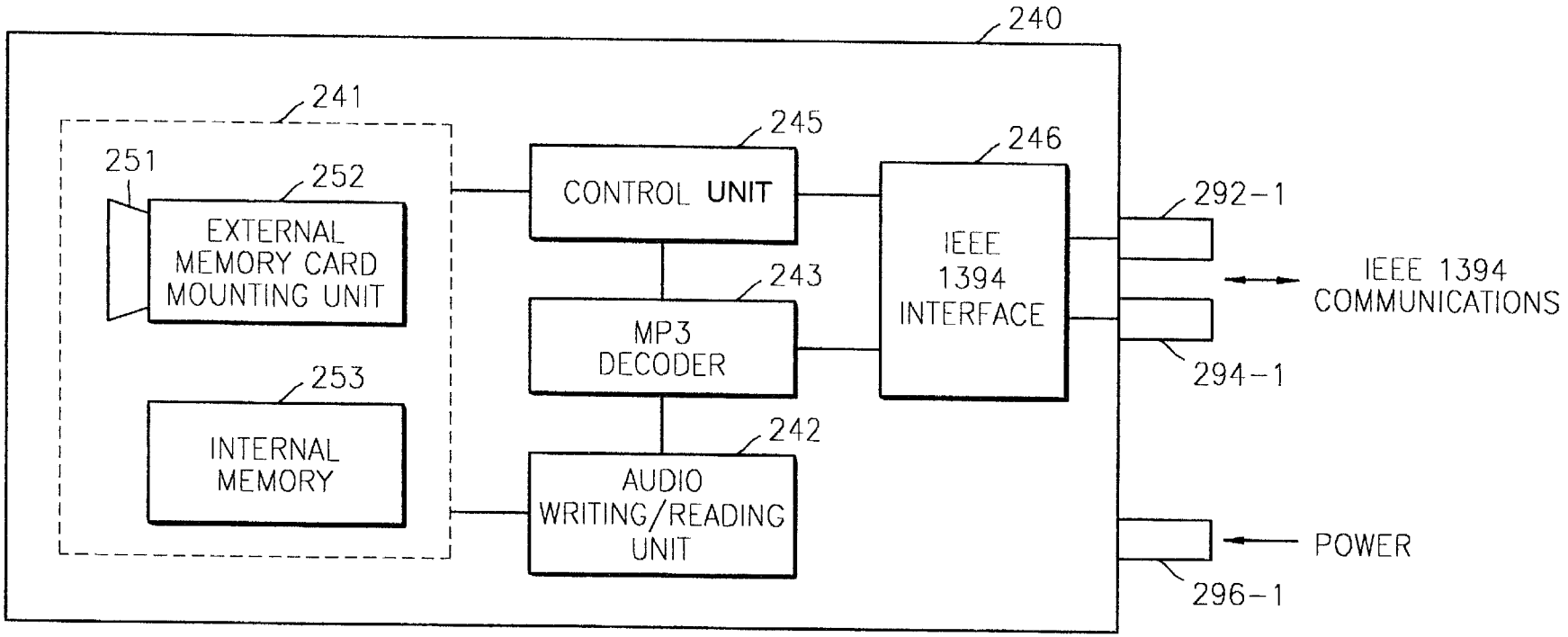
FIG. 5 is a block diagram of a preferred embodiment of the music file recording/reproducing module of FIG. 4.

FIG. 5 is a block diagram of a preferred embodiment of the music file recording/reproducing module of FIG. 4. Referring to FIG. 5, the music file recording/reproducing module 240 has an audio storage unit 241, an audio writing/reading unit 242, an MP3 decoder 243, a control unit 245, and an IEEE1394 interface 246. Also, the music file recording/reproducing module 240 has communications ports 292-1 and 294-1 and a power connection port 296-1, which protrude from the casing of the music file recording/reproducing module 240.

The control unit 245 has a central processing unit (CPU), a ROM, a flash memory and control circuitry. In particular, a control program for performing communications with the base module 100 in a client-server fashion is stored in the ROM. Control information contained in an index page is for controlling the music file recording/reproducing module 240. The flash memory stores the IP address and other information of the music file recording/reproducing module 240.

The audio storage unit 241 has an external memory card mounting unit 252 and an internal memory 253. The internal memory 253 has a flash memory and a RAM. In particular, the RAM may be used as a buffer for processing audio data, that is, an MP3 file. The external memory card mounting unit 252 enables mounting of an external memory card 251 which may be implemented as a smart memory card. The audio writing/reading unit 242 writes an MP3 file, which is received from the IEEE1394 interface 246, in the audio storage unit 241, or reads an MP3 file stored in the audio storage unit 241, that is, in the internal memory 253 or in the external memory card 251. The MP3 decoder 243 decodes a received MP3 file.

MP3 is an algorithm for encoding audio data. The size of an ordinary music file in a compact disc (CD) is about 30~50 MB but, if a music file is encoded (compressed) using the MP3 algorithm, the size of data can be reduced to 1/12 the original size while maintaining similar sound quality.

The MP3 decoder 243 decodes a music file (audio data) encoded by the MP3 algorithm. The communications interface unit 246 is an IEEE1394 interface module having an IEEE1394 link part, an IEEE1394 physical part, and a processor. The processor controls the IEEE1394 link part and the IEEE1394 physical part, and sends an MP3 file decoded by the MP3 decoder 243 to the base module 100. That is, the IEEE1394 link part divides audio data, which is sent from the MP3 decoder 243, into units of a frame based on the IEEE1394 protocol, and sends the frames to the IEEE1394 physical part. The IEEE1394 physical part sends the received frames in units of a bit stream complying with the IEEE1394 protocol. By doing so, bit streams are sent to the base module 100 through the communications ports 292-1 and 294-1.

Figure 6:
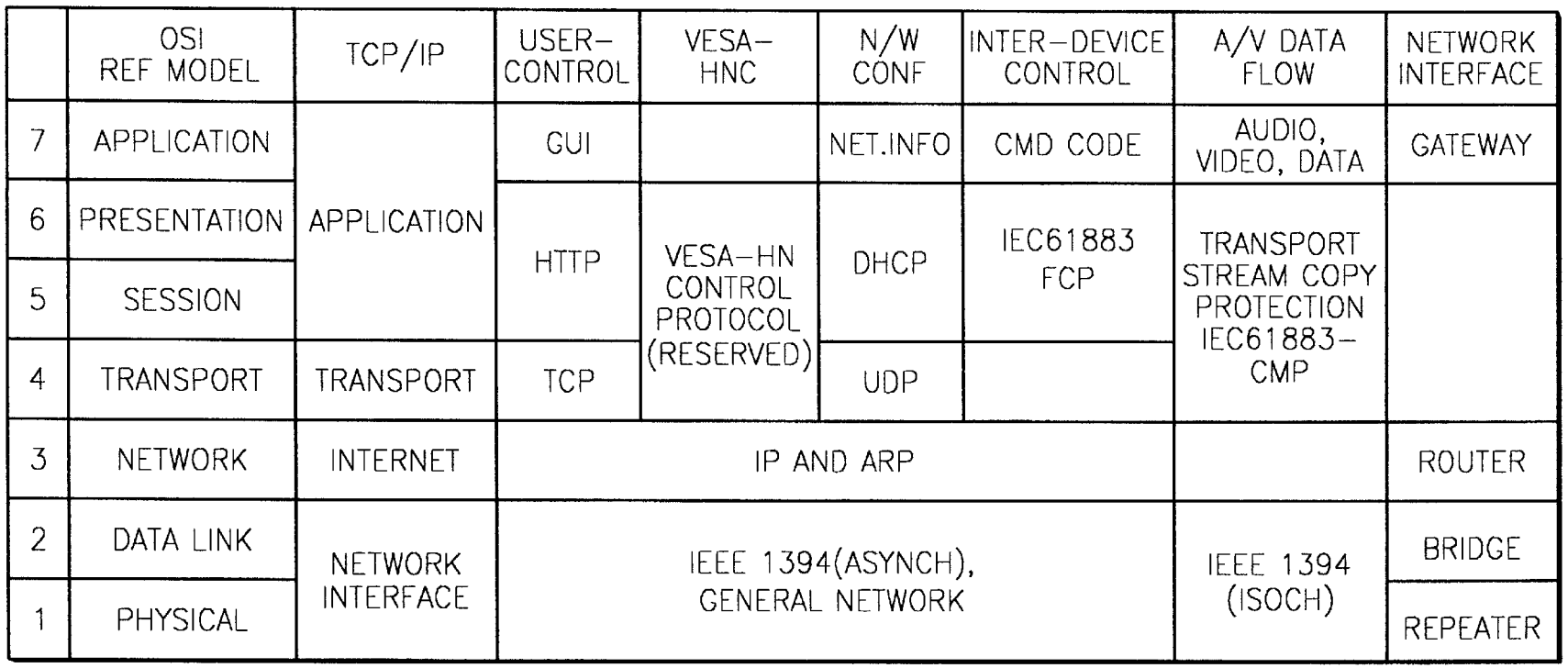
FIG. 6 is a schematic diagram of a communications protocol structure adopted for communications between a base module and a music file recording/reproducing module.

FIG. 6 is a reference diagram of a communications protocol structure, which is adopted for communications between the base module 100 and the music file recording/reproducing module 240 in a client-server fashion according to a preferred embodiment of the present invention. The communications protocol structure is compared with the OSI reference model and TCP/IP layer structure in FIG. 6. Referring to FIG. 6, a graphical user interface (GUI) is adopted for user-control in the application layer, and the base module 100 and the music file recording/reproducing module 240 communicate with each other in a client-server fashion based on a hyper text transfer protocol (HTTP). In the transport layer, packet communications are performed based on the TCP/IP protocol (address resolution protocol (ARP)), and the IEEE1394 protocol is adopted in the physical layer and the data link layer (OSI reference model). However, a protocol adopted in each layer may change in various ways according to necessity.

Figure 7:
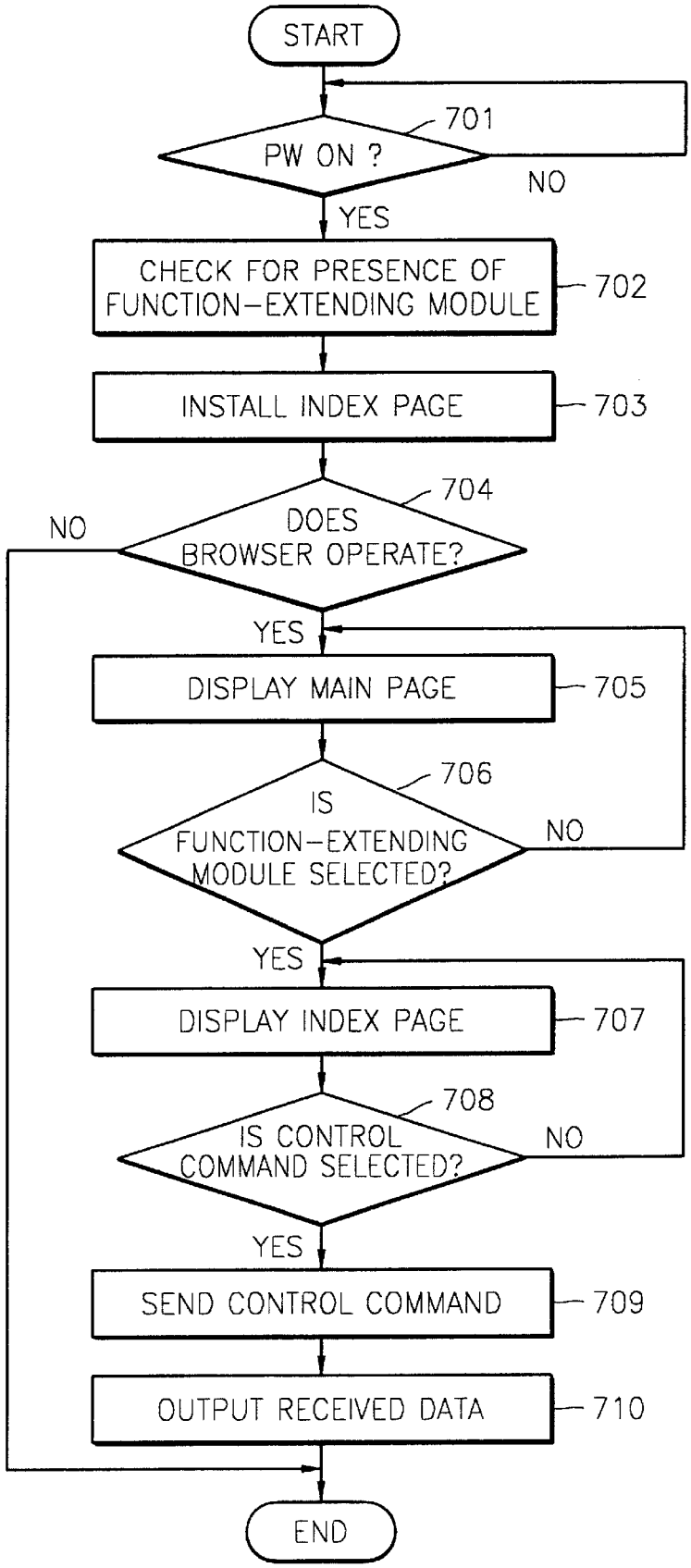
FIG. 7 is a flowchart of a process for reproducing a music file with a music file recording/reproducing module.

FIG. 7 is a flowchart of a process for reproducing a music file with the music file recording/reproducing module 240 of FIG. 5. Referring to FIG. 7, if the modular TV system is turned on in step 701, the base module 100, which is a client, confirms whether or not the music file recording/reproducing module 240, which is a server, is mounted in the module rack 16 in step 702.

The mounted music file recording/reproducing module 240 sends an index page to the base module 100, and the base module 100 receives and installs the provided index page in step 703. The music file recording/reproducing module 240 also sends an IP address, and the base module 100 stores the received IP address. The step for sending and receiving the IP address may be performed independently of step 703.

Figure 8:
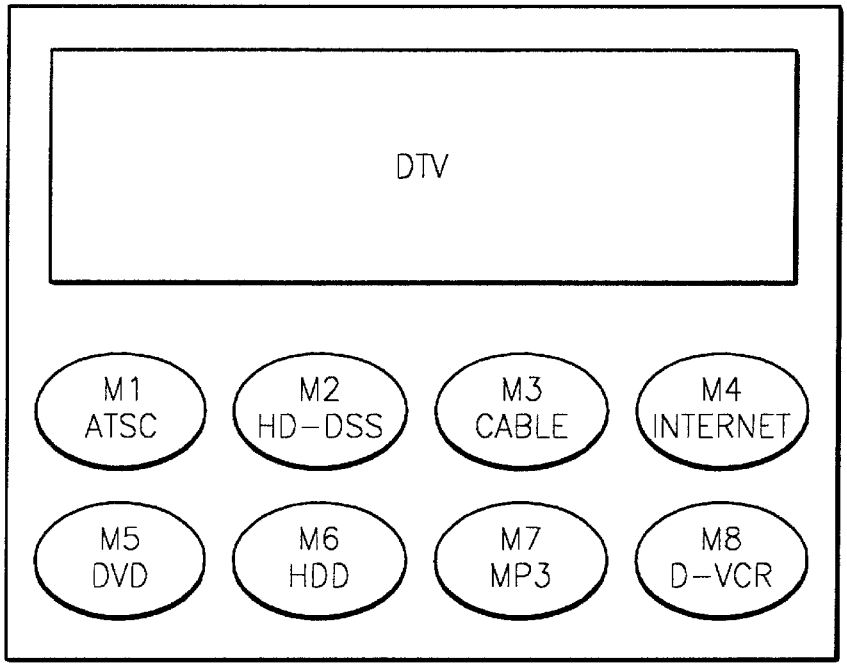
FIG. 8 is a diagram of an example of a main page.

If a user operates the browser installed in the base module 100 in step 704, a main page, such as the page shown in FIG. 8, is displayed in step 705. In the main page, icons indicating various function-extending modules (M1 through M8) are displayed as seen in FIG. 8. In that regard, M1 indicates a digital broadcast receiving module, M2 indicates a digital satellite broadcast receiving module, M3 indicates a cable broadcast receiving module, M4 indicates an Internet access module, M5 indicates a digital versatile disc (DVD) module, M6 indicates a hard disc drive (HDD) module, M7 indicates an MP3 module as the music file recording/reproducing module 240 according to the present invention, and M8 indicates a D-VCR module. Icons may be sent by respective function-extending modules and displayed, or may be stored in the base module 100 and displayed. If a main page is formed so that an icon is sent by each corresponding function-extending module after it has been requested, the manufacturer of the function-extending modules may load various icons on the function-extending modules so that icons displayed in the main page can change in various ways.

If the user selects the MP3 module displayed on the main page in step 706, the browser installed in the base module 100 calls up and displays the index page of the music file recording/reproducing module 240 in step 707. In response to the user's selection, while omitting step 703, the index page may be called directly from the corresponding music file recording/reproducing module 240 in step 707.

Figure 9:
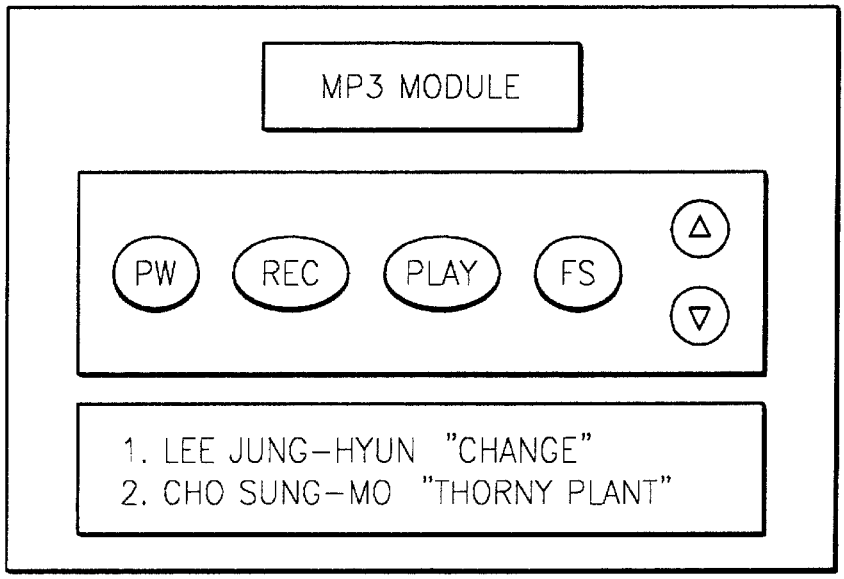
FIG. 9 is a diagram of an example of an index page of a music file recording/reproducing module.

As shown in FIG. 9, a GUI-type user interface is prepared in the displayed index page. As function buttons, the index page has a power on/off button (PW), a record button (REC), a play button (PLAY), and a file search button (FS). If the user selects a predetermined function button in step 708 of FIG. 7, the selected control command (the user input) is sent to the corresponding music file recording/reproducing module 240 in step 709, and the music file recording/reproducing module 240 performs an operation according to the received control command in step 710. For example, if the user selects the file search button (FS), the music file recording/reproducing module 240 sends list information of music files stored in the audio storage unit 241 to the base module 100, and then the list of music files is displayed as shown in FIG. 9. If the user selects a predetermined music file in the list, the selection information is again sent to the music file recording/reproducing module 240, and the audio writing/reading unit 242 reads the corresponding music file from the audio storage unit 241, and sends the music file to the MP3 decoder 243. Then, the MP3 decoder 243 decodes the music file, and sends the decoded file to the IEEE1394 interface 246 under control of the control unit 245 so that the decoded file is sent to the base module 100. The base module 100 processes the audio data received from the music file recording/reproducing module 240, and outputs the data to the speaker 12 so that the music file is reproduced.

Figure 10:
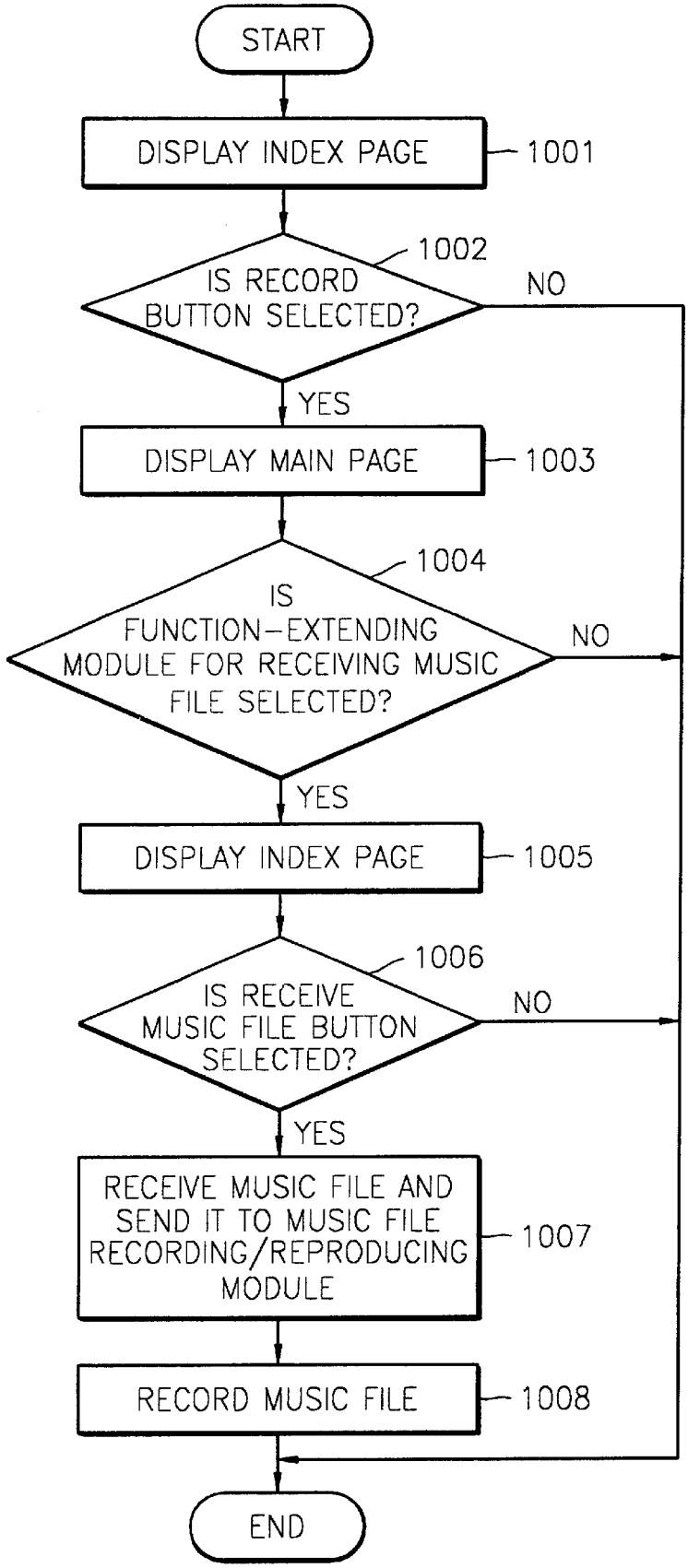
FIG. 10 is a flowchart of a process for recording a music file with a music file recording/reproducing module.

FIG. 10 is a flowchart of a process for recording a music file with a music file recording/reproducing module. Referring to FIG. 10, after performing the same steps as steps 701 through 707 of FIG. 7, the index page of the music file recording/reproducing module 240, as shown in FIG. 9, is displayed in step 1001.

Figure 11:
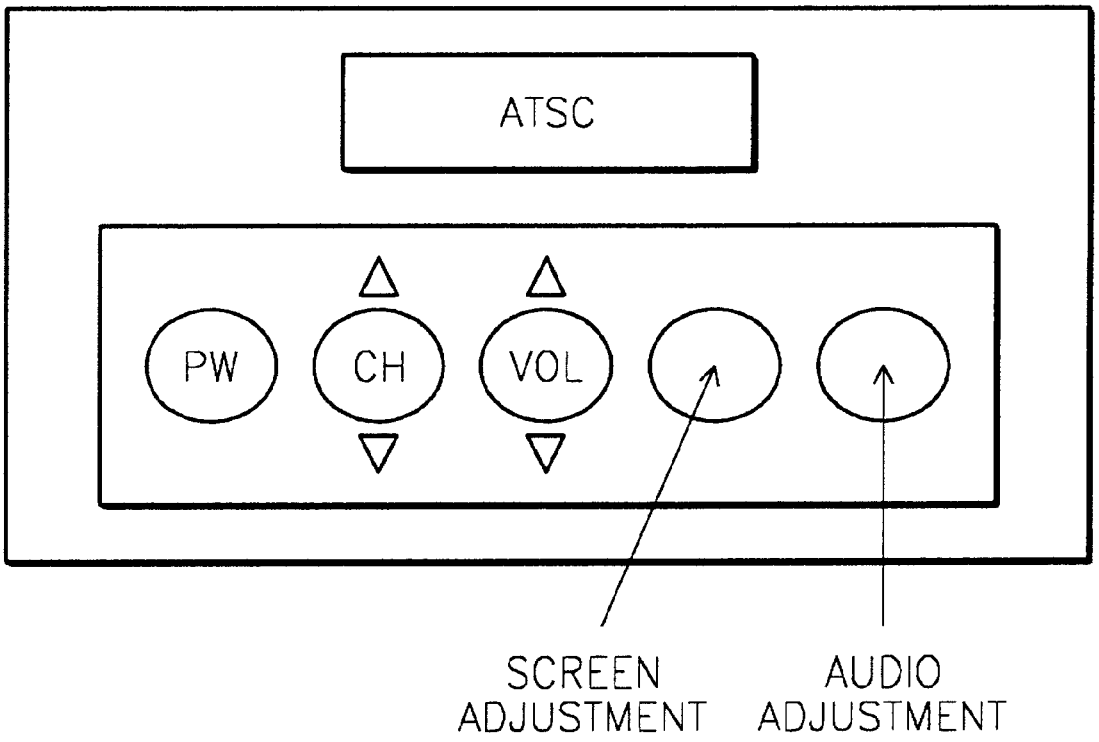
FIG. 11 is a diagram of an example of an index page for controlling a digital broadcast receiving module.

The user sets the music file recording/reproducing module 240 to a record mode by selecting the record button (REC) in step 1002. Then, the main page is called up and displayed in step 1003, and selection of a function-extending module for receiving a music file is determined in step 1004. The function-extending module for receiving a music file may be the digital broadcast receiving module, the Internet access module, or the hard disc drive module. Next, the base module 100 displays the index page of the selected function-extending module in step 1005. For example, if the digital broadcast receiving module is selected, the index page shown in FIG. 11 is displayed.

If the user selects the music file receiving button, as determined in step 1006, a music file from the outside is received, and the base module 100 sends the received music file to the music file recording/reproducing module 240 in step 1007. The audio write/read unit 242 of the music file recording/reproducing module 240 writes the received music file to the audio storage unit 241 in step 1008. In particular, when a digital broadcast is received through the digital broadcast receiving module, the digital broadcast is received in the form of an MPEG transport stream, and therefore the signal processing unit 110 of the base module extracts MP3 audio data from the MPEG transport stream sent by the digital broadcast receiving module, and sends the extracted audio data to the music file recording/reproducing module 240. In this case, an MP3 extraction part for extracting MP3 audio data from the digital broadcast may be included in the digital broadcast receiving module or in the music file recording/reproducing module 240 instead of in the base module 100. If the MP3 extraction part is in the digital broadcast receiving module, an MP3 music file is sent to the base module 100 by the digital broadcast receiving module, and the base module 100 sends the received MP3 music file to the music file recording/reproducing module 240. If the MP3 extraction part is in the music file recording/reproducing module 240, the base module 100 sends an MPEG transport stream directly to the music file recording/reproducing module 240, and the music file recording/reproducing module 240 extracts an MP3 music file from the received MPEG transport stream, and writes the MP3 music file to the audio storage unit 241.

As described above, according to the present invention, there is provided a music file recording/reproducing module which receives a music file from the outside, stores the music file, and decodes the received music file so that the music file can be reproduced. With the music file recording/reproducing module, various music files such as an MP3 file transmitted through the Internet can be received, stored, and reproduced.

This invention has been described above with reference to the aforementioned embodiments. It is evident, however, that many alternatives, modifications and variations will be apparent to those having skill in the art in the light of the foregoing description. Accordingly, the present invention embraces all such alternatives, modifications and variations as fall within the spirit and scope of the appended claims and their equivalents.

What is claimed is:

1. A music file recording/reproducing module which can be inserted into a module rack formed in an audio/video (AV) system mounting a base module, capable of reproducing audio data and, the music file recording/reproducing module comprising:

a communications interface unit for receiving audio data, which is encoded by a predetermined encoding method, from the AV system;

a decoder for decoding the audio data, which is encoded by the encoding method; and a control unit programmed and configured to send control information for controlling the music file recording/reproducing module to the base module when the music file recording/reproducing module is inserted into the module rack, the control unit also being programmed and configured to send the audio data, which is decoded by the decoder, to the AV system, according to instructions from the base module based on the sent control information.

2. The music file recording/reproducing module of claim 1, further comprising:

an audio storage unit in which the audio data is recorded; and an audio writing unit for writing the encoded audio data in the audio storage unit;

wherein the control unit receives a record command from a user, and sends the record command to the audio writing unit.

3. The music file recording/reproducing module of claim 2, further comprising an audio reading unit for reading the encoded audio data written in the audio storage unit, wherein the decoder decodes the encoded audio data read by the audio reading unit, and wherein the control unit receives the read command from the user, sends the read command to the audio reading unit, and sends the audio data, which is decoded by the decoder, to the AV system.

4. The music file recording/reproducing module of claim 3, wherein the audio storage unit comprises:

an external memory card in which the audio data encoded by the encoding method is stored; and an external memory card mounting unit in which the external memory card is detachably mounted.

5. The music file recording/reproducing module of claim 4, wherein the encoding method is an MP3 method and the decoder is an MP3 decoder.

6. The music file recording/reproducing module of claim 4, wherein the AV system has an IEEE1394 interface module, and the communications interface unit is an IEEE1394 interface module which communicates with an additional IEEE1394 interface module contained in the AV system.

7. The music file recording/reproducing module of claim 3, wherein the encoding method is an MP3 method and the decoder is an MP3 decoder.

8. The music file recording/reproducing module of claim 3, wherein the AV system has an IEEE1394 interface module and the communications interface unit is an IEEE1394 interface module which communicates with an additional IEEE1394 interface module contained in the AV system.

9. The music file recording/reproducing module of claim 2, wherein the encoding method is an MP3 method and the decoder is an MP3 decoder.

10. The music file recording/reproducing module of claim 1, wherein the encoding method is an MP3 method and the decoder is an MP3 decoder.

11. The music file recording/reproducing module of claim 1, wherein the AV system has an IEEE1394 interface module and the communications interface unit is an IEEE1394 interface module which communicates with an additional IEEE1394 interface module contained in the AV system.

12. A music file recording/reproducing module which can be inserted into a module rack formed in an audio/video (AV) system mounting a base module, capable of reproducing audio data and, the music file recording/reproducing module comprising:

a communications interface means for receiving audio data, which is encoded by a predetermined encoding method, from the AV system;

a decoder means for decoding the audio data, which is encoded by the encoding method; and a control means programmed and configured to send control information for controlling the music file recording/reproducing module to the base module when the music file recording/reproducing module is inserted into the module rack, the control means also being programmed and configured to send the audio data, which is decoded by the decoder, to the AV system, according to instructions from the base module based on the sent control information.

13. The music file recording/reproducing module of claim 12, further comprising:

audio storage means for recording audio data; and audio writing means for writing the encoded audio data in the audio storage means;

wherein the control means receives a record command from a user, and sends the record command to the audio writing means.

14. The music file recording/reproducing module of claim 13, further comprising audio reading means for reading the encoded audio data written in the audio storage means, wherein the decoder means decodes the encoded audio data read by the audio reading means, and the control means receives a read command from the user, sends the read command to the audio reading means, and sends the decoded audio data to the AV system.

15. The music file recording/reproducing module of claim 14, wherein the audio storage means comprises:

an external memory card in which the encoded audio data is stored; and an external memory card mounting unit in which the external memory card is detachably mounted.

16. The music file recording/reproducing module of claim 13, wherein the storage means comprises:

an external memory card in which the encoded audio data is stored; and an external memory card mounting unit in which the external memory card is detachably mounted.

17. The music file recording/reproducing module of claim 12, wherein the encoded audio data is produced by an MP3 encoding method and the decoder means comprises an MP3 decoder.

18. The music file recording/reproducing module of claim 17, wherein the AV system has an IEEE1394 interface module, and the communications interface means comprises an IEEE1394 interface module which communicates with an additional IEEE1394 interface module contained in the AV system.

19. The music file recording/reproducing module of claim 12, wherein the AV system has an IEEE1394 interface module, and the communications interface means comprises an IEEE1394 interface module which communicates with an additional IEEE1394 interface module contained in the AV system.

20. A method of reproducing digital music in a modular, integrated audio/visual system and a modular music module, said method comprising the steps of:

inserting said modular music module into a base module of the audio/visual system to establish an electrical connection between the music module and the audio/visual system;

transferring control information from the music module to the audio/visual system causing said audio/visual system to control the music module according to the transferred control information sent from the music module to the audio/visual system;

transferring encoded digital music data from said audio/visual system into said music module;

decoding the received encoded digital music data in said music module;

transferring the decoded digital music data from the music module to the audio/visual system according to the control information transferred from the music module to the audio/visual system; and converting said transferred decoded music data into audible signals that are played on speakers attached to said audio/visual system.

* * * * *